US008500914B2

(12) United States Patent
Fritsche

(10) Patent No.: US 8,500,914 B2
(45) Date of Patent: Aug. 6, 2013

(54) DEVICE FOR BLOWING OFF BOTTLE BOTTOMS

(75) Inventor: Claas Fritsche, Dortmund (DE)

(73) Assignee: KHS GmbH, Dortmund (DE)

( * ) Notice: Subject to any disclaimer, the term of this patent is extended or adjusted under 35 U.S.C. 154(b) by 315 days.

(21) Appl. No.: 12/922,664

(22) PCT Filed: Feb. 5, 2009

(86) PCT No.: PCT/EP2009/000784
§ 371 (c)(1),
(2), (4) Date: Sep. 14, 2010

(87) PCT Pub. No.: WO2009/118076
PCT Pub. Date: Oct. 1, 2009

(65) Prior Publication Data

US 2011/0005553 A1 Jan. 13, 2011

(30) Foreign Application Priority Data

Mar. 28, 2008 (DE) ..... 10 2008 016 322

(51) Int. Cl.
*B08B 5/00* (2006.01)
*A47L 5/38* (2006.01)

(52) U.S. Cl.
USPC ..... 134/21; 134/42; 15/303; 15/304; 141/98

(58) Field of Classification Search
None
See application file for complete search history.

(56) References Cited

FOREIGN PATENT DOCUMENTS

| | | | |
|---|---|---|---|
| DE | 9401929 | | 4/1994 |
| DE | 20317458 | | 6/2004 |
| DE | 20317458 | U1 * | 7/2004 |
| DE | 20 2006 014110 | | 2/2007 |
| DE | 202006014110 | U1 * | 3/2007 |
| JP | 63 082989 | | 4/1988 |

OTHER PUBLICATIONS

English Machine Translation of DE 20 2006 014 110 U1.*
English Machine Translation of DE 203 17 458 U1.*
"Of many rare Threatening Danger Hygiene Measures in Bottle Wine Cellar" *Brewing Industry Journal* pp. 484-86 (Aug. 1998).

* cited by examiner

*Primary Examiner* — Nicole Blan
(74) *Attorney, Agent, or Firm* — Occhiuti Rohlicek & Tsao LLP

(57) ABSTRACT

With the device (1) according to the invention for blowing off impurities on bottle bottoms, in particular bottle inspection machines, a solution is to be created which makes it possible to achieve an optimum blow-off result at comparatively lower air volume flows. This is achieved according to the invention in that beneath the nozzle head (3) in the annular body (5) a channel (6) is provided, which is connected to a compressed air line (7), which in turn is linked to the compressed air feed line (9), wherein the channel (6) in the upper edge pointing to the nozzle head (3) forms an annular gap (14)—triggering the Venturi effect.

11 Claims, 2 Drawing Sheets

DEVICE FOR BLOWING OFF BOTTLE BOTTOMS

CROSS-REFERENCE TO RELATED APPLICATIONS

Figure 2:
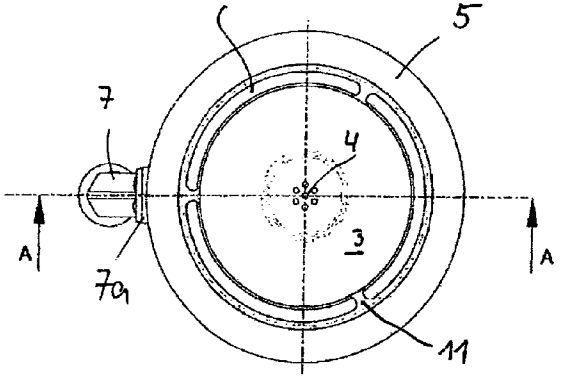

This application is the National Stage of International Application No. PCT/EP2009/000784, filed on Feb. 5, 2009, which claims the benefit of German Application Serial No. 10 2008 016 322.8, filed on Mar. 28, 2008, the contents of both of the foregoing applications are hereby incorporated by reference in their entirety.

The invention centres on a device for blowing off bottle bottoms, in particular for bottle inspection machines, said device having a mushroom-shaped nozzle head with a compressed air outlet channel that is directed against the bottom of a bottle that is located thereabove and an annular body that surrounds the nozzle head at a spacing.

When bottles are being filled, corresponding bottle filling systems use so-called inspection machines to detect impurities on or in the bottles, x-raying the bottles from the underside being known.

In order to ensure that where impurities are present they are situated in the interior of the bottle, the outer surface of the bottles has to be cleaned of impurities, for instance lubricants adhering to the bottle bottom that can adhere to the bottles through the system itself and suchlike. Any foam that may be present from the cleaning systems also has to be removed.

At any rate, the process of blowing off the bottle bottoms is known, as is described, for example, in German utility patent 94 01 929 U. The "Brewing Industry" journal August 1998, pages 484-486, looks at hygiene measures, amongst other things also a bottle cleaning machine. This type of blowing off device is also shown in the generic German utility patent 203 17 458 U. It has been shown that in the case of these blowing off devices large volumes of air have to be moved, i.e. large volumes of air have to be sucked off with the impurities, high volume flows necessitating comparatively high costs with the economic disadvantages involved.

This is where the invention fits in, its object being to find a cost-effective solution for these types of devices by means of which it is possible to achieve an optimum result for the blowing off process, using comparatively smaller air volume flows.

This object is achieved according to the invention in that a channel is provided in the annular body beneath the nozzle head, said channel being impinged upon from a compressed air line, which, in its turn, is connected to the compressed air supply line, wherein the channel, in the upper edge pointing to the nozzle head, forms the annular gap—triggering the Venturi effect.

The achievement of this measure is that by means of the additional annular flow that is not directed onto the bottle bottom, a type of Venturi effect is generated which is used directly to suck off the cleaning air flow.

A number of advantages are linked to this measure. Thus, only one pressure supply line is necessary for the blowing off device, said supply line at the same time also providing for the necessary negative pressure for the suction process via its "bypass line" by means of the Venturi effect in the outlet annular gap. An additional suction line, consequently, is no longer necessary.

An additional advantage is that the design is extremely simply, sturdy and cost-effective.

Additional developments of the inventions are produced from the sub claims. In this case, it can be provided in particular that in the annular body a bypass tube with an outer groove for forming the channel is provided, where applicable in an axially displaceable manner. In this case, the diameter of the bypass tube can be slightly smaller at its upper end facing the nozzle head than the diameter of the oppositely situated inside wall.

This design is extremely simple in terms of manufacturing, the diverted gas flow or the negative pressure being precisely adjustable through the axial adjustability of the outflow groove that gives rise to the Venturi effect.

The invention also provides that both the bypass tube and the annular body are provided with grooves that face each other in the operating position in order to optimize the flow channel for the air flow triggering the Venturi effect.

This optimizing of the flow also serves an additional measure according to the invention that is produced in that the bypass tube is rounded-off at its upper inside edge that faces the nozzle head.

The invention also provides that the annular body has an inwardly facing shoulder, which, in the upper outer edge of the bypass tube faces a gap formation.

Another simpler structural development of the invention is that the nozzle head is retained by a support element, e.g. a support plate, that is provided with suction openings in the edge gap.

To solve the above-formulated object, the invention also provides a method for blowing off impurities on bottle bottoms, said method being distinguished in that the negative pressure necessary for the suction is generated beneath the nozzle head by means of a diverted portion of the blowing off air that enters via an annular gap and triggers a Venturi effect.

The advantages already specified above are achieved by means of this method of operation, i.e. only one single compressed air supply is required, a portion of said blowing off air then being drawn on in a bypass for generating a negative pressure beneath the nozzle head.

One development, in this case, provides that the negative pressure is regulated by adjusting the size of the annular gap.

Figure 1:
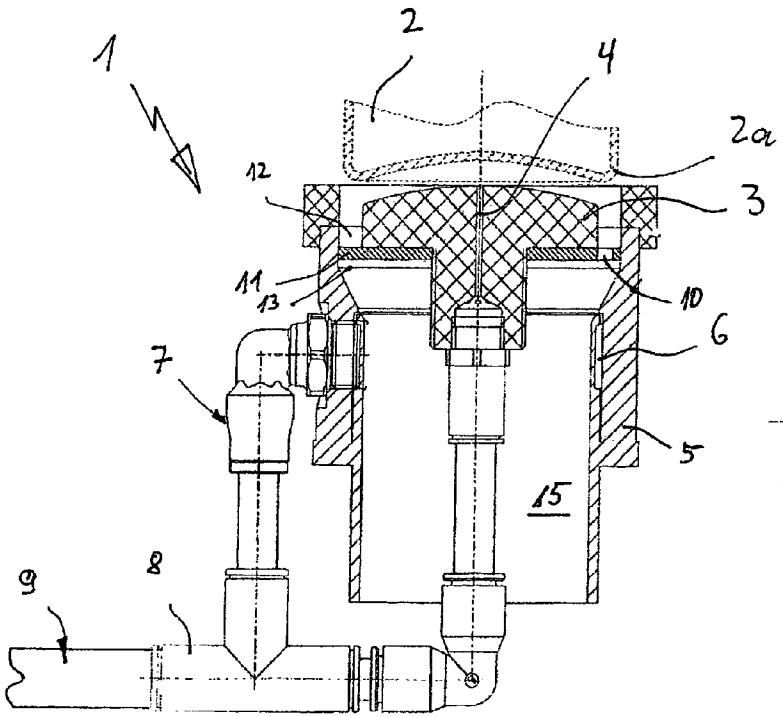
Figure 3:
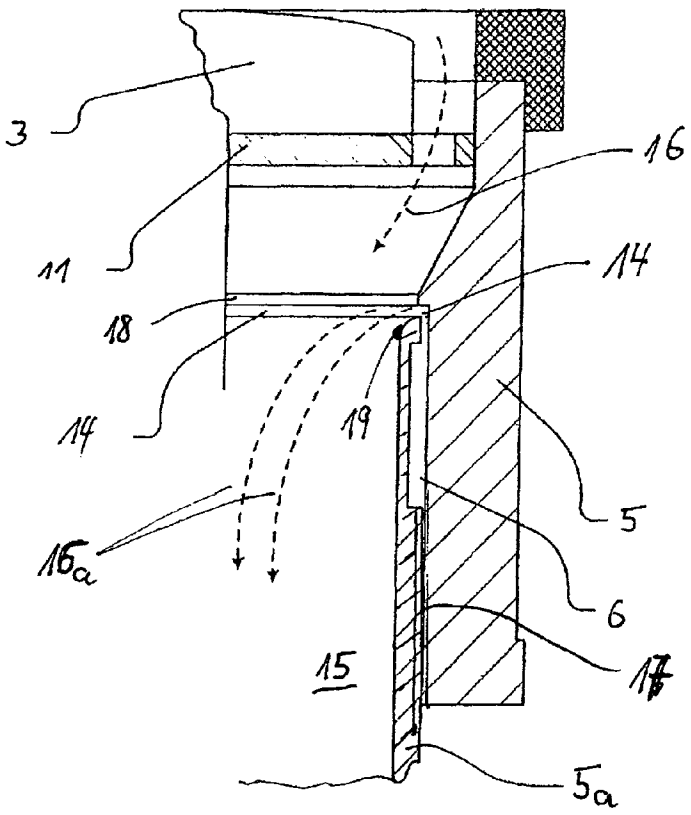

Additional features, details and advantages of the invention are produced on account of the following description and by way of the drawings, in which:

FIG. 1 shows a sectional representation through the air supply and nozzle region of a blowing off device (not shown otherwise in any more detail) approximately according to the line I-I in FIG. 1, FIG. 2 shows a top view according to the line II-II in FIG. 1 and FIG. 3 shows an enlarged detailed representation of the nozzle region in section.

The device for blowing off a bottle bottom 2*a* of a bottle 2 that is only depicted in a suggestive manner is given the general reference 1. It has an approximately mushroom-shaped nozzle head 3 with a central compressed air outlet channel 4 that is directed against the bottom 2*a* of the bottle 2.

The mushroom-shaped nozzle head 3 is surrounded by an annular body 5, which, on its inner wall beneath the mushroom head 3, has a circumferential annular channel 6, which is impinged upon from a bypass compressed air line 7, through which compressed air from the compressed air supply line 9 is supplied via a T-piece 8 into the annular channel 6.

The compressed air supplied into the annular channel 6 is blown into the interior space of the annular body 5 via a gap 14, said interior space being given the reference 15.

As can be seen in FIG. 1, the nozzle head is retained by a support plate 11 that is provided with passages 10, such that the air flowing through the central compressed air outlet channel 4 can flow through the annular gap, given the reference 12, between the annular body 5, on the one side, and the mushroom-shaped nozzle head 3, on the other side, downward into the interior space 15 of the annular body 5, all of which is indicated in FIG. 3 by a broken line arrow 16. Said flow is forced by the Venturi effect that is generated on account of the nozzle gap 14. The corresponding flow arrows are provided with the reference 16*a* in FIG. 3.

It is also indicated in FIG. 3 that the annular body 5 can be realized in two parts, with, on the one hand, an upper annular element supporting the support plate 11 and the nozzle head 3 and a bypass tube 5*a* that is screw-connected therein via a thread 17, it being possible to adjust the width of the gap 14 by means of the thread 17.

In the case of the design represented in FIG. 3, the annular body 5 has an inwardly facing collar, which forms a shoulder 18, against which the rounded-off upper free end 19 of the bypass tube 5*a* can be displaced in order to adjust said gap width.

Naturally, it is also possible to modify the described exemplary embodiment of the invention in many respects without departing from the inventive concept. Thus, the invention is not restricted to the specific development or embodiment of the annular channel 6 or of the bypass tube 5*a* in the annular body 5 and suchlike.

The invention claimed is:

1. A device for blowing against and blowing off bottle bottoms, said device comprising: a nozzle head with a compressed air outlet channel that is directed against a bottom of a bottle that is located thereabove, an annular body that surrounds the nozzle head and is separated from the nozzle head by a space, and a channel provided in the annular body beneath the nozzle head, said channel being impinged upon by a compressed air line connected to a compressed air supply line, wherein the channel, in the upper edge pointing to the nozzle head, forms an annular gap that triggers the Venturi effect.

2. The device according to claim 1, wherein the nozzle head is mushroom-shaped.

3. The device according to claim 1, further comprising, in the annular body, a bypass tube with an outer groove for forming the channel, where applicable in an axially displaceable manner.

4. The device according to claim 3, wherein the bypass tube is rounded-off at an upper inside edge thereof facing the nozzle head.

5. The device according to claim 3, wherein the annular body has in inwardly facing shoulder, which, in the upper outer edge of the bypass tube, faces a gap formation.

6. The device according to claim 3, wherein the bypass tube comprises grooves that face each other in the operating position.

7. The device according to claim 1, wherein the annular body comprises grooves that face each other in the operating position.

8. The device according to claim 1, wherein the nozzle head is retained by a support element provided with suction openings in the annular gap.

9. The device according to claim 8, wherein the support element comprises a support plate.

10. A method for blowing off impurities on bottle bottoms inside a bottle inspection machine, said method comprising blowing against the bottle bottoms with compressed air; and sucking away air contaminated by the impurities, wherein negative pressure for sucking away contaminated air is generated beneath a nozzle head using a diverted portion of the air used to blow against the bottle bottoms, said diverted air having entered via an annular gap that triggers the Venturi effect.

11. The method of claim 10, further comprising adjusting the size of the annular gap to regulate the negative pressure.

* * * * *